US008136514B2

(12) United States Patent
Howard et al.

(10) Patent No.: US 8,136,514 B2
(45) Date of Patent: Mar. 20, 2012

(54) DEVICE FOR PROPELLING A PROJECTILE

(75) Inventors: Jack Ryan Howard, America Fork, UT (US); Patrick L. Muscarella, Penfield, NY (US)

(73) Assignee: JRH Industries, LLC, Bluffdale, UT (US)

( * ) Notice: Subject to any disclaimer, the term of this patent is extended or adjusted under 35 U.S.C. 154(b) by 629 days.

(21) Appl. No.: 12/183,018

(22) Filed: Jul. 30, 2008

(65) Prior Publication Data

US 2009/0032002 A1 Feb. 5, 2009

Related U.S. Application Data

(60) Provisional application No. 60/952,887, filed on Jul. 31, 2007.

(51) Int. Cl.
*F41B 5/10* (2006.01)

(52) U.S. Cl. ..... 124/23.1; 124/1; 124/16; 124/25; 124/25.6; 124/86

(58) Field of Classification Search ..... 124/1, 16, 124/25, 25.6, 86, 23.1
See application file for complete search history.

(56) References Cited

U.S. PATENT DOCUMENTS 2,714,377 A * 8/1955 Mulkey ..... 124/23.1
3,744,473 A * 7/1973 Nishioka ..... 124/25.6
3,812,835 A * 5/1974 Smith ..... 124/25.6
3,981,290 A * 9/1976 Islas ..... 124/25.6
4,227,509 A * 10/1980 Jones ..... 124/25.6
4,287,867 A * 9/1981 Islas ..... 124/25.6
4,457,288 A * 7/1984 Ricord ..... 124/25.6
4,458,657 A * 7/1984 Stockmar ..... 124/17
4,471,747 A * 9/1984 Nishioka ..... 124/23.1
4,512,326 A * 4/1985 Jarrett ..... 124/25.6
4,530,342 A * 7/1985 Simo ..... 124/23.1
4,646,708 A * 3/1987 Imes ..... 124/23.1
4,651,707 A * 3/1987 Bozek ..... 124/17
4,672,943 A * 6/1987 Bozek ..... 124/25.6
4,711,228 A * 12/1987 Gillespie ..... 124/25
4,756,295 A * 7/1988 Guzzetta ..... 124/16
4,757,799 A * 7/1988 Bozek ..... 124/25.6
4,803,970 A * 2/1989 Mattheck et al. ..... 124/23.1
4,817,580 A * 4/1989 Butterfield ..... 124/25.6
4,858,588 A * 8/1989 Bozek ..... 124/23.1
4,903,677 A * 2/1990 Colley et al. ..... 124/23.1
(Continued)

OTHER PUBLICATIONS

Gurstelle, W.; The Art of the Catapult; c. 2004 William Gurstelle; Publisher Chicago Review Press, Incorporated; ISBN1-55652-526-5; pp. 14-15, 18-21, 48-49, 60-69.

*Primary Examiner* — Gene Kim
*Assistant Examiner* — Alexander Niconovich
(74) *Attorney, Agent, or Firm* — Duane C. Basch; Basch & Nickerson LLP

(57) ABSTRACT

An archery or similar projectile launching device having a spring assembly to energize the device and a release mechanism to transmit energy stored within a torsion or alternative spring to the bowstring, so as to accelerate an arrow nocked to the bowstring once the trigger is released. In one embodiment, conjoined cranks wind a torsion spring within a spring motor affixed along the riser of the bow while the bowstring and arrow are concurrently brought into the discharge position. A mechanical advantage may be achieved with the cranking mechanism to reduce the effort exerted by the archer and thereby increase accuracy, velocity and ease of use.

19 Claims, 9 Drawing Sheets

U.S. PATENT DOCUMENTS 4,971,020 A * 11/1990 Soderstrom et al. ..... 124/23.1
5,054,463 A * 10/1991 Colley et al. ..... 124/25.6
5,150,699 A * 9/1992 Boissevain ..... 124/25.6
5,205,269 A * 4/1993 Guzzetta ..... 124/25.6
5,353,777 A * 10/1994 Fincher ..... 124/16
5,373,831 A * 12/1994 Cushman ..... 124/25.6
5,503,135 A * 4/1996 Bunk ..... 124/16
5,638,804 A * 6/1997 Remick et al. ..... 124/25.6
5,673,677 A * 10/1997 Wing ..... 124/20.3
5,722,385 A * 3/1998 Bunk ..... 124/86
5,950,609 A * 9/1999 Thielen et al. ..... 124/25.6
6,055,974 A * 5/2000 Dieziger ..... 124/23.1
6,698,413 B1 * 3/2004 Ecklund ..... 124/25.6
7,201,161 B1 * 4/2007 York ..... 124/16
7,740,011 B1 * 6/2010 Bernardy ..... 124/23.1
7,891,348 B2 * 2/2011 Colley ..... 124/25
2010/0269807 A1 * 10/2010 Kempf ..... 124/25

* cited by examiner

DEVICE FOR PROPELLING A PROJECTILE

This application claims priority from U.S. Provisional Patent Application 60/952,887 for a "TORSION SPRING DEVICE FOR PROPELLING A PROJECTILE," filed Jul. 31, 2008 by J. Ryan Howard et al., which is also hereby incorporated by reference in its entirety.

The disclosed device relates in general to a force amplifying bow or similar device for propelling or launching a projectile, and more specifically, to an improved bow using a torsion spring as an energizing means that is operatively associated with the bowstring to thereby improve accuracy, arrow velocity and ease of use.

BACKGROUND AND SUMMARY

In archery, and particularly bow hunting, arrow speed is dependent upon several factors, one being the amount of energy or force the bow is able to develop and deliver to the arrow. Generally speaking the more total energy put into the bow, the faster the arrow will be propelled. Increased arrow speed is desirable, especially when hunting with or shooting heavy arrows and over greater distances. However, the operation of a bow with greater energy or force is difficult because of the effort required to draw the bowstring, and for this reason many people are not capable of producing sufficient force to provide a traditional bow (e.g., compound bows) with the necessary energy to effectively propel the arrow. Even persons who have sufficient strength to draw a bow find it difficult to shoot accurately since aiming the bow and holding the drawn bowstring must be accomplished simultaneously, absent any extraneous motion, and the drawn position must sometimes be maintained for many seconds and even minutes before the target is clear for a shot.

In response to the shortcomings of the long bow and recurve bow, the compound bow was developed. The compound bow offers several mechanical advantages over traditional straight and recurve bows. By and large, compound bows provide more thrust than non-compound bows, and often have a "let-off" whereby the bow may be maintained in a drawn position with less force than was necessary to initially draw the bow. Also, a compound bow is generally more compact in terms of size for a given energy capacity.

In order for a compound bow to be effective, by current standards, it must be capable of producing a specific level of performance in terms of arrow velocity and accuracy. Acceptable performance with respect to arrow velocity is defined within industry standards established by the Archery Trade Association (ATA) where about a 60 lb. peak draw force, being drawn back a distance of 30 in. will propel a 540 grain arrow at a velocity within a range of 200 to 250 feet per second (140-170 MPH). Accuracy, on the other hand, is subjective because the level of precision shooting obtainable with any given bow is not controlled by the bow alone, but rather the product of the bow/arrow/archer combination. However, one characteristics of a bow design that tends to be more influential towards accuracy is arrow velocity. The trajectory, or arc, of an arrow is increasingly diminished (i.e., closer to a straight-line) as arrow velocity increases, therefore providing a more predictable and straight-line placement of the arrow relative to the target.

Accordingly, a compound bow is designed to provide a mechanical advantage in order to reduce the force that an archer must apply to the bow while increasing the overall energy stored by the bow. Most compound bow designs use cams or elliptical wheels on the ends of the riser to optimize the leverage exerted by the archer and to reduce or "let-off" the holding force of the bow as a full draw is approached. Let-off, as noted above, is when the force required to hold the bowstring at full draw is substantially less than the force required to draw or hold the bowstring in an intermediate position between the undrawn and fully drawn positions. Upon release of a bowstring, which has been loaded with an arrow, the force propelling the arrow at a given position while nocked on the bowstring is proportional to the force required to hold the bowstring stationary in that position. In accordance with an aspect of the disclosed embodiments, using means such as levers to provide mechanical advantage, and a drawing mechanism, less force is required to hold a bow at full draw. As a result the muscles take longer to fatigue, thus giving the archer or hunter sufficient time to relax and aim, similar to the advantages of a compound bow or even a cross bow. In accordance with other aspects of the devices disclosed herein, the adjustability of such devices permit the use of the device across a wide range of users (e.g., sizes, arm length, strength), and permit a smaller size than conventional archery equipment.

In recent years, a number of improvements have been made to compound bows; most notably the use of the bowstring and associated springs to store potential energy having a non-linear power curve. This has proven to significantly enhance the overall control of the force applied to the arrow when the bowstring is released because the high potential energy is not instantaneously captured by the arrow in the form of kinetic energy at the moment the bowstring is released, thereby avoiding accuracy degradation resulting from the imparted shock.

In this regard, compound archery bows have been devised by generally utilizing a rigging of the bowstring with respect to one or more cams or pulleys that are rotatably mounted to a riser having a compression spring therebetween. In this configuration the bowstring is pulled by the archer to compress or expand the springs having an arrow nocked to the bowstring. While the flexible bowstring remains an effective means to transmit the propelling force from the spring to the arrow, it is less than effective as a "crank" to wind up springs due to its small cross-section and flexibility. An improvement to conventional devices includes applying a rotational force to a "spring," as found in the disclosed embodiments. Although various means for energizing the spring may be disclosed, one means includes a rigid lever having an ergonomic handle, such that the lever may be employed to energize the spring. In the case of a bow, the disclosed embodiment serves to relieve the archer of discomfort resulting from pulling on a string with the index and middle fingers (or via a wrist-attached release mechanism) by providing a discrete rigid lever action member having a user friendly linkage to place the bow in a fully drawn position, without the archer having any direct interaction with the loaded bowstring and arrow. Such a device is not only believed to provide an adjustable (customizable) archery device, but to further improve safety by reducing the likelihood or unintentional release of arrows when a user exerts significant draw force.

Accordingly, it is the object of the disclosed embodiments to provide a bow with a linked lever for the angular rotation of at least one spring motor to provide a propelling force to the bowstring, which thereby transfers the force to the arrow shaft.

It is also an object of the disclosed device or system to provide a spring driven, high-energy "bow" wherein the required drawing and holding force may be achieved independently of the bowstring, the bow also having a trigger or similar mechanism for the release and transfer of the spring-stored energy to the bowstring.

In accordance with yet another aspect of the disclosed device, the spring driven bow includes a bowstring that is directly linked or connected to elements of at least one spring motor.

Another object of the inventive device is to provide an archery bow in which at least one wound torsion spring is used as the energy storing medium.

It is a further object to provide an improved bow that is compact, efficient, powerful, ergonomic, lightweight and is also distinct in appearance, operation and portability.

Other and further objects, features and advantages will be evident from a reading of the following specification and by reference to the accompanying drawings forming a part thereof, wherein the examples of the presently preferred embodiments are given for the purposes of disclosure.

In accordance with one aspect of the disclosed embodiments there is provided a projectile launching device (bow), comprising; a rigid riser; a hand grip operatively associated with said riser; at least one spring assembly operatively connected to said rigid riser, said spring assembly including a rotating member operatively associated therewith; a string operatively associated with said spring assembly such that each end of the bowstring is attached to the rotating member; a projectile releasably attached to said bowstring; and means to energize said spring assembly, where upon release of energy stored in said spring assembly said rotating member rotates and said bowstring to launches the projectile.

In accordance with another aspect of the disclosed embodiments, there is provided an archery bow, comprising: a rigid riser; a hand grip operatively associated with said riser; at least one spring assembly operatively connected to said rigid riser, said spring assembly including a spring and a rotating member operatively associated therewith; a string operatively associated with said spring assembly such that each end of the bowstring is attached to the rotating member; an arrow releasably attached to said bowstring; and a pair of engaged spring cranks releasably connected to said spring assembly to energize said assembly and rotate said rotating member in a first direction, where upon release of energy stored in said spring said rotating member rotates in a second direction, opposite the first direction, applying increased tension to the bowstring and launching the arrow.

In accordance with another aspect of the disclosed embodiments, there is provided a method for drawing and releasing a bow to propel an arrow, comprising: applying a linear drawing force to move a pair of engaged spring cranks, the cranks being releasably connected to a spring assembly, to energize said spring by rotating a member attached to said spring in a first radial direction; concurrently drawing a bowstring, with an arrow nocked thereto, said bowstring having each end thereof attached to the member; decoupling the spring assembly from the spring cranks; and releasing energy stored in said spring wherein said member rotates in a second direction, opposite the first direction, and said bowstring propels the arrow.

Other and further objects, features and advantages will be evident from a reading of the following specification and by reference to the accompanying drawings forming a part thereof, wherein the examples of the presently preferred embodiments are given for the purposes of disclosure.

The various embodiments described and depicted herein are not intended to limit the scope to those embodiments described. On the contrary, the intent is to cover all alternatives, modifications, and equivalents as may be included within the spirit and scope of the appended claims.

DETAILED DESCRIPTION

Figure 1:
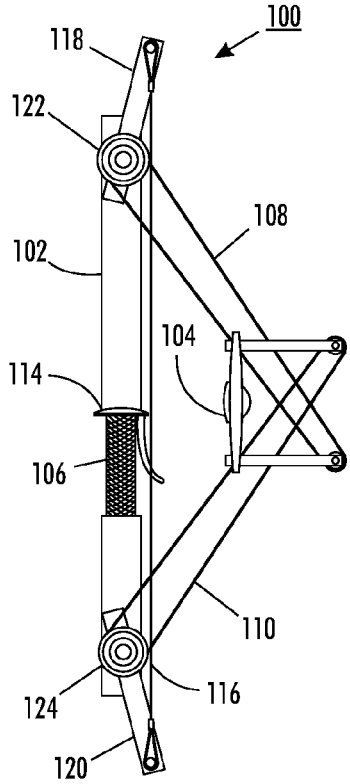
FIG. 1 is an upright left side planar view of a bow having a pair of torsion spring assemblies in a relaxed position.
Figure 2:
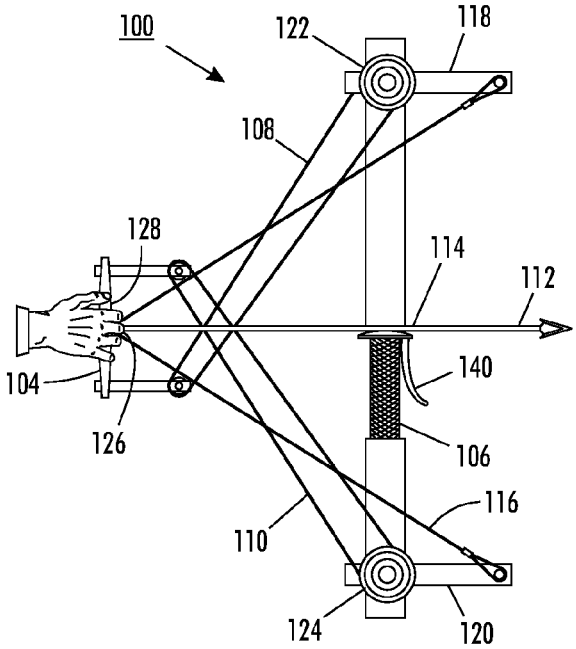
FIG. 2 is an upright left side planar view of the bow of FIG. 1 in a drawn position.

With particular reference to the drawings, FIGS. 1 and 2 show an overview of one embodiment of the improved bow 100. In this embodiment, an archery bow 100 includes a riser 102 providing a backplane for the mounting of the elements required to propel an arrow in a right handed archer configuration. Riser 102 is a rigid member and does not include leaves or similar flexural elements as in a conventional compound bow. In the embodiment of FIGS. 1 and 2, the riser includes an integral rearward hand grip 106 that is positioned midway between the extreme ends of the riser and likely somewhat below the horizontal center line of riser 102 so the arm of an archer is less likely to interfere with the arrow in the drawn position, as shown in FIG. 2.

Associated with grip 106 is release trigger 140 (FIG. 7) to releasably decouple the arms that energize spring assemblies 122 and 124 from the springs and permit the discharge of the arrow in the fully drawn position. It will be appreciated that various trigger mechanisms may be employed in place of the release trigger depicted in FIG. 7, however, such mechanisms should be capable of being actuated by a user's finger(s) or thumb. Moreover, it is also contemplated that the release mechanism may be associated with the archer's other (draw) hand, for example on hand grip 104. Additionally, positioned just above grip 106 and situated substantially along the horizontal center line of riser 102 is arrow rest 114, which serves as a support pad for arrow 112. Any of a number of conventional arrow rests may be employed in accordance with the disclosed embodiments.

Continuing to refer to FIG. 1, upper spring motor or assembly 122 is secured to the top end of riser 102, likewise lower spring motor or assembly 124 is secured to the bottom end of the riser. While shown as in-line with riser 102, the spring motors could alternatively be mounted perpendicular to the riser. Notably spring motors 122 and 124 are essentially identical in construction, albeit the motors operate in contrary rotational directions, specifically motor 122 when discharged rotates counterclockwise and conversely motor 124 rotates in a clockwise direction.

Although generally depicted as torsion-type springs, the present disclosure further contemplates the use of alternative, spring-driven members that operate in a general rotational relationship relative to the riser. For example, the rotation of levers 118 and 120, relative to riser 102 are depicted in FIGS. 1 and 2 as being under the control of a torsion or wound spring 122, 124. In an alternative embodiment, the torsion spring could be replaced with a tension or compression spring between the riser and levers to impart a similar spring force. Furthermore, the spring(s) themselves may be replaced with charged cylinders and piston assemblies (e.g., pneumatic, hydraulic) that similarly serve to store energy when the arms are moved and then provide for rapid release of the energy in order to transfer the energy from the "spring" to the bowstring and associated arrow or other projectile.

The opposite ends of bowstring 116 are each cinched within a take-up lever by means of a loop inserted within a bifurcated end of the upper and lower bowstring take-up levers, 118 and 120 respectively. While levers 108 and 110 cause the bow to be energized, bowstring 116 is situated within arrow socket 128 by means of an interference fit, so as to remain taut, to remove slack from the string, while moving in unison with take-up levers 118 and 120 as they rotate to energize springs 132.

Figure 3:
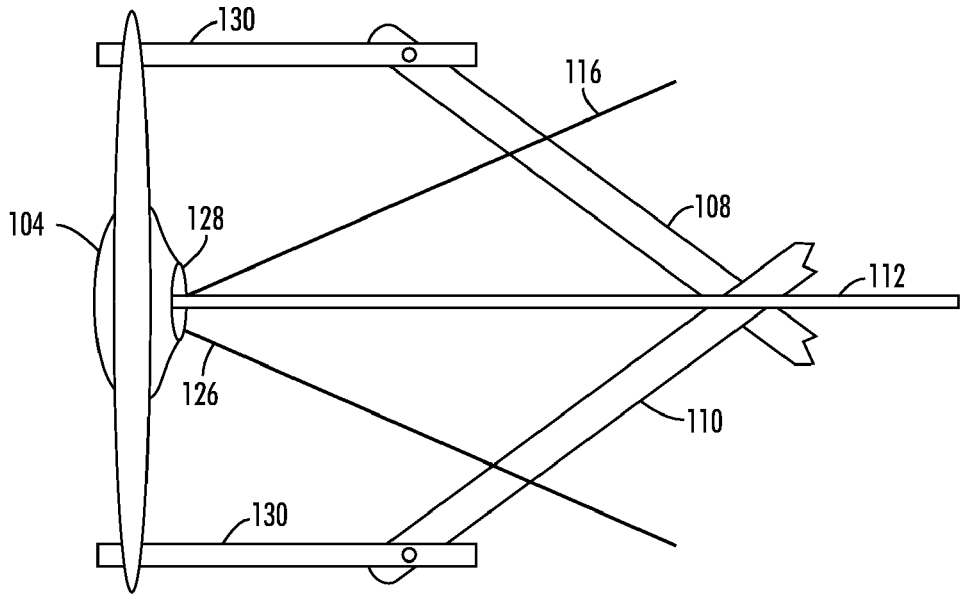
FIG. 3 is a side view of an arrow socket.

Referring also to FIG. 3, arrow nock 128 and bowstring 116, in combination, are inserted and frictionally secured within arrow socket 128, on hand grip 104, by virtue of a receiving cavity, or similar opening, that provides a tendency force to predispose the arrow into a shooting position. In other words, arrow socket 128 will provide an adequate force to retain the arrow/bowstring in an aligned position while drawing the bow from rest yet allow arrow 112 to escape socket 128 by inertia, once the bow is fired and the arrow has been moved away from hand grip 104.

Figure 4:
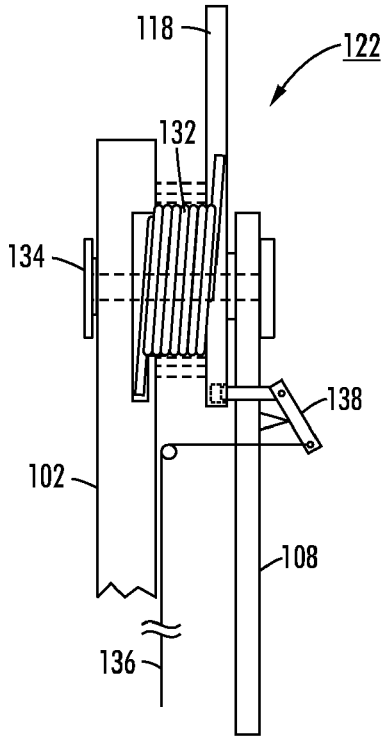
FIG. 4 is a cutaway view of the torsion spring assembly.
Figure 5A:
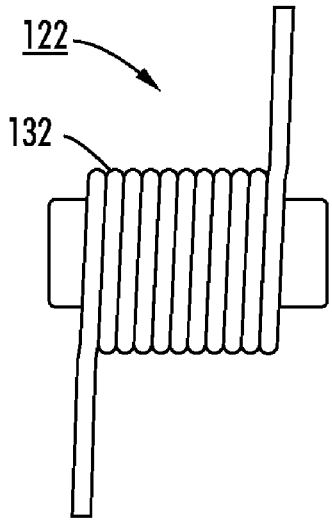
FIGS. 5A-D are isometric views of the torsion spring in various configurations.
Figure 5B:
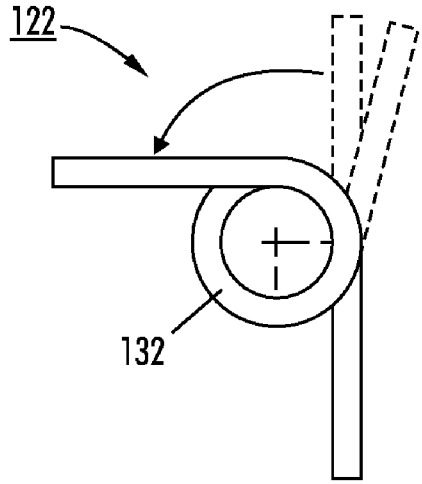
Figure 5C:
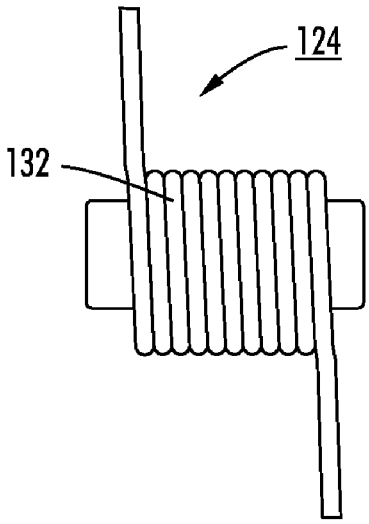
Figure 5D:
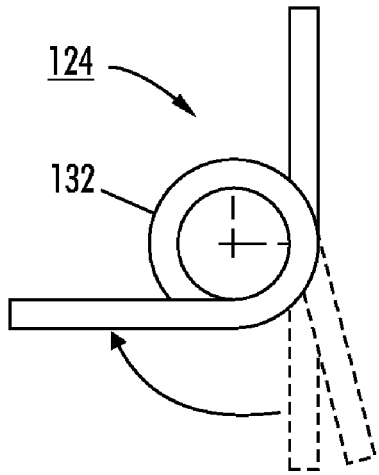
Figure 6:
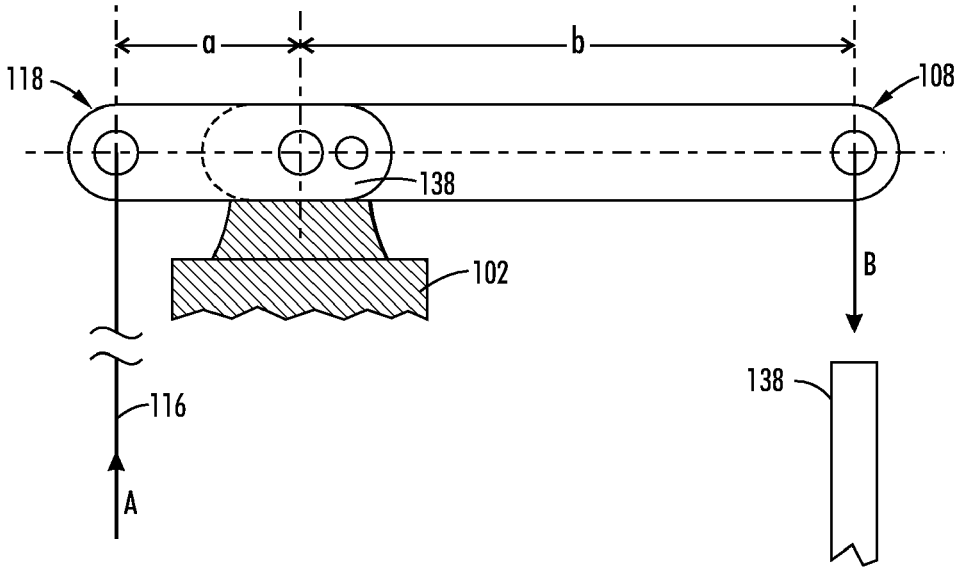
FIG. 6 illustrates a simplified vector-force diagram of the bow.

The arrow launching energy is generated by first rotating torsion spring 132 about pivot pin 134, as viewed in FIG. 4, where one exposed end of the spring is operatively coupled to the riser 102 and the other exposed end of the spring is operatively coupled to the bowstring take-up lever (e.g., 118, 120). As previously discussed the relative lengths of take-up lever 118 and the spring crank 108 provide the necessary mechanical advantage so as to significantly reduce the effort required by the archer to develop a high power launching force. The dual, but joined beam, depicted in FIG. 6 shows a functional vector diagram of bow 100 having a relatively low vector force B translated to a relatively high vector force A. The force is thusly increased in the ratio of the forces A:B, which is approximately equal to the ratio of the distances to the fulcrum b:a. This ratio establishes the mechanical advantage, or the bow power index. Now, assume in FIG. 5 that crank 108 and lever 118 are contiguous members having a fulcrum point 134 therebetween, and crank 108 is three times longer than lever 118. Given the equation Force=(Mass) (Distance) and a 3:1 ratio, for example, a 30 pound force moving crank 108 a distance of 18 inches will yield an ultimate force of 90 pounds moving a distance of 6 inches or (30 lbs)(18 in)=(90 lbs)(6 in), neglecting any energy loss due to friction. Therefore, the present embodiment provides a means to accommodate the requirements of the archer by adjusting the "a" to "b" ratio by simply moving the fulcrum point or varying the length of a moment arm.

Furthermore, to facilitate a smooth, but rapid transfer of energy to the arrow, take-up levers 118 and 120 may include a curvilinear profile whereby a cam like shape of the levers coincides with the power curve necessary to overcome inertia and provide a non-linear force to account for the acceleration of the arrow. This feature takes into consideration that an arrow at rest initially requires high energy/low velocity whereas in contrast a moving arrow needs a low energy/increasing velocity as it gains speed. The disclosed embodiments rely on the Laws of Motion to essentially regulate the power transfer in response to the reactive or resistive forces from the bow mechanics and the arrow.

According to the disclosed embodiments an initial displacement force is applied by the user between forward hand grip 104 and rearward hand grip 106 providing an energy input into spring motor or assembly 122 that serves as a potential energy buffer or reservoir. The device intentionally requires that the energy to move the drawbar or handle 104 rearward requires a generally constant force over the range of movement from an at-rest position in front of the riser 102 (e.g., FIG. 1) to a fully drawn position rearward of riser 102 (e.g., FIG. 2). In other words, the generally continuous force requirement does not require or exhibit a let-off as one might experience in compound bows. Accordingly, as seen between FIGS. 1 and 2, crank 108 and 110 provide the energy input or energizing means and lever 118 and 120 the energy output means. As seen in FIG. 4, actuation of a release mechanism, such as release pin 138, will disengage lever 118 from crank 108 and consequently convey an instantaneous force from spring 132 to bowstring 116 via take-up lever 118. In one embodiment, the release of the energy from the torsion spring motor(s) 122 will only be possible when at full draw as the release mechanism will only work when the spring(s) is at full torque and has reached the full draw position. This feature is also unlike conventional re-curve and compound bows. Another advantage of the disclosed device is that it cannot be over-drawn because the arms are intentionally limited in the amount of draw (the included angle over which the arms travel from an at-rest to a fully drawn position).

Figure 7:
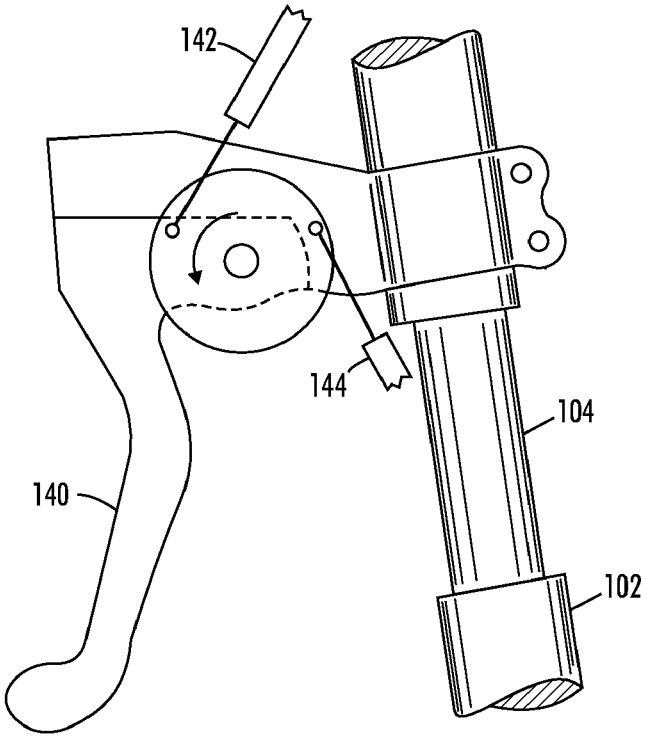
FIG. 7 shows a planar view of a release mechanism.

Other equivalent release mechanisms may include a ratchet, pawl, clutch and the like. In a similar manner lower spring motor 124 operates in accordance to the aforementioned specification in tandem with the upper spring motor 122. An enabling aspect of the dual spring motor design is the ability to simultaneously release the stored spring energy; accordingly both release pins 138 are connected to a common actuator, and may have a synchronization adjustment to assure the coincident release by both spring motors. Also, as noted above, the release mechanism operates to prevent release unless the spring motors are at a fully-drawn state, thereby preventing the inadvertent release during draw or energizing of the spring. Referring to FIG. 7, a release trigger or similar mechanism 140 communicates with release pins 138 by upper and lower flexible cables 142 and 144 respectively. Trigger 140 is illustrated in the nature of a handle or lever, but it is understood that any mechanism suitable for actuation by a finger or thumb of the user when a hand is present on the handle 104 is also contemplated. In the illustrated embodiment, release trigger 140 is conveniently located adjacent rearward hand grip 106 so it may be actuated with minimal impact upon launching of arrow 112 and not offset the absolute aim point. It is noted that releasing spring motors 122 and 124 out of phase may by and large impart adverse dynamics into the flight trajectory of the arrow. Accordingly, release equalizer 146 provides for a balancing adjustment to make certain that the release is simultaneous.

Spring motor 122, in the embodiment depicted in FIG. 4, comprises a helical torsion spring as seen in FIGS. 5A-D, that encircles pivot pin 134, and exerts a torque or rotary force. In one embodiment, torsion spring 122 may be formed from 17-7 PH Stainless Steel having a diameter of about 0.283 in., and seven coils. The wire coil has a diameter of about 0.880 in. and a leg length of about 2.5 in. legs. The approximate weight of the torsion spring is 0.56 lbs. The springs may be fabricated according to custom requirements for orientation, spring force, torque, etc. One leg of torsion spring 132 is attached to riser 102 and held stationary while the opposite leg follows the rotational motion of take-up lever 118. It will be appreciated that alternative spring configurations and particularly alternative spring designs may be employed in accordance with aspects of the disclosed device. Spring crank 108, during the energizing cycle, is disengageably connected to both spring 132 and take-up lever 118 by means of release pin 138, as depicted in functional FIG. 6, and they are pivotally disengaged from one another during the firing cycle. For all intents and purposes lower spring motor 124 operates in substantially the same manner, except spring 132 is wound in the opposite direction as viewed in FIG. 5.

In one embodiment the spring leg attachment point to riser 102 is adjustable to enable the pre-loading of spring motor 122 with an initial force. A torsion spring constant is measured by in-lbs/deg. deflection, therefore a quiescent spring provides a zero force. The primary objective of pre-loading is to establish an offset so as to shift the range of force, for example, given a spring constant of 0.5 in-lbs/deg, the force varies from 0 to 45 lbs over a 90-degree deflection. Given the same spring with a 10 degree offset or "preload," the force range is 5 to 95 lbs. Again, as discussed above, with adjustable moments and also a variable load offset adjustment, the disclosed bow embodiments are readily adaptable to an archer's various attributes of size, strength and skill.

Figure 8A:
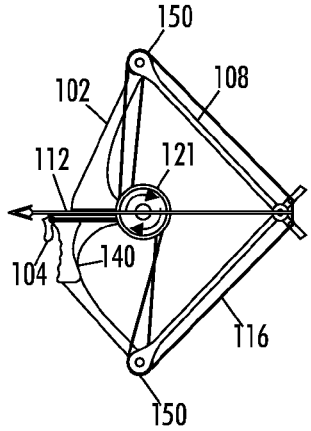
FIG. 8A is a side perspective view of a single spring bow with cranks to assist in energizing the spring assembly.
Figure 8B:
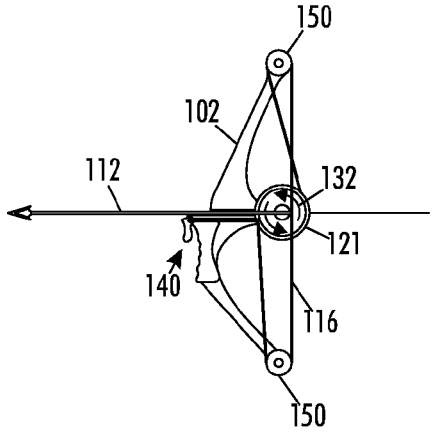
FIG. 8B is a side view of a single spring bow in a static (undrawn) state.
Figure 8C:
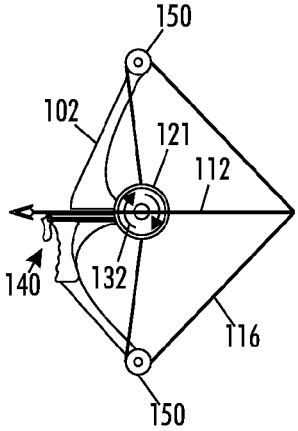
FIG. 8C is a side view of a single spring bow in a dynamic (drawn) state.
Figure 9:
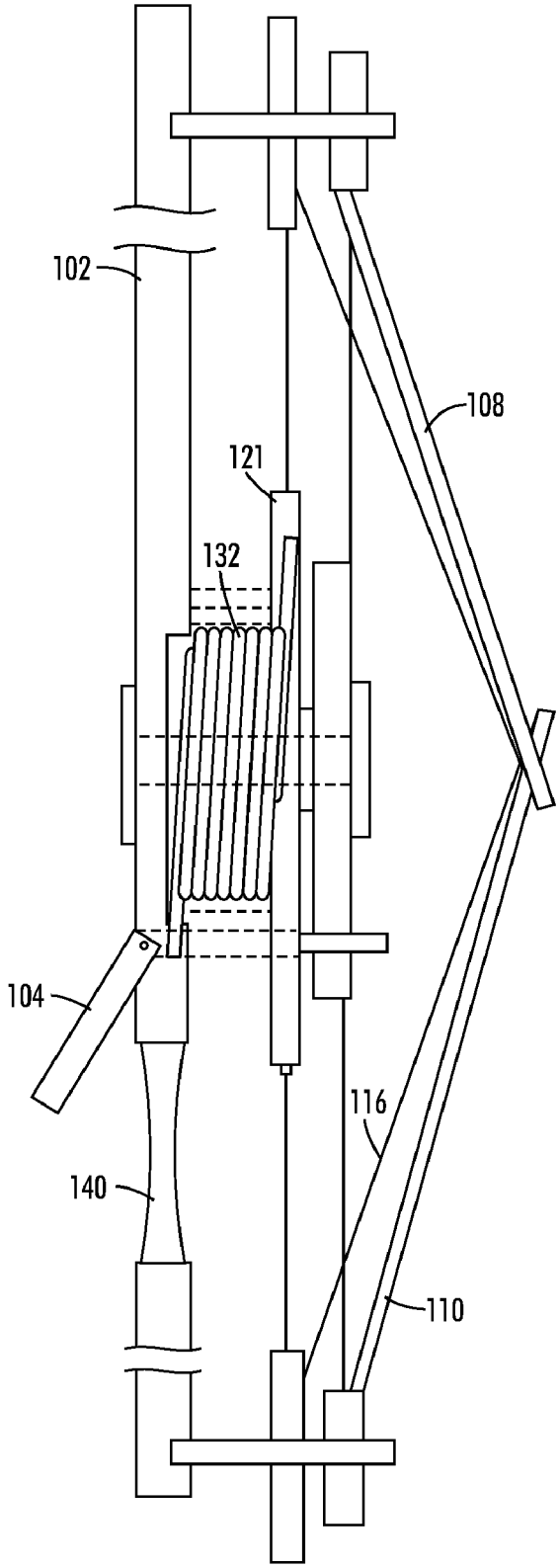
FIG. 9 is an isometric end view of a single spring bow.

Referring to FIGS. 8A-C and 9, in an alternative embodiment, a central spring is substituted for the two outboard springs described above. Various aspects of this configuration are seen in FIGS. 8A-C where the spring is wound using dual levers 108 and 110 moving in unison to turn a single rotating member 121 to which the ends of bowstring 116 are attached. The inherent advantage of this embodiment is having the arrow launching energy derived from a single source thereby reducing or eliminating the need to assure spring motor synchronization, hysteresis and inertia. The fundamental operation remains the same in the embodiment depicted in FIGS. 8A-C and 9, whereby a torsional spring 132 is energized, using levers 108 and 110, decoupled from rotating member 121 by releasing trigger 140 and thereby placing bowstring 116 in tension so as to propel arrow 112.

Referring to FIGS. 8B and 8C and the above discussion relative to a single spring motor device, both levers 110 and 108 respectively are eliminated, and bowstring 116 is directly attached to rotating member 121 and thereby to associated torsion spring 132. Rotating member 121 still provides a mechanical advantage to energize spring 132 through a moment arm that is defined by the path of bowstring 116 as rotating member 121 rotates as arrow 112 is drawn into a firing position. For example, if bowstring 116 follows the perimeter of member 121 a uniform rotational displacement occurs from about 0 to about 90 degrees. However, it is possible to alter the displacement by having a variable distance or moment between bowstring 112 and the axis of rotating member 121. For example rotating member 121 may be eccentrically shaped or mounted so as to act like a cam as bowstring 116 is moved, thereby modifying the force required to pull the bowstring. As previously mentioned the intrinsic advantage of having the arrow launching energy derived from a single spring motor eliminates the potential problem with synchronizing the operation of a pair of springs. While the embodiment of FIGS. 8B and 8C further eliminates levers 108 and 110, the mass associated with the embodiment, and possibly the system inertia, is significantly decreased and the overall design is appreciably simplified. Furthermore, as contrasted with the earlier embodiment, it is clear that several alternative means (levers, bowstring, etc.) for energizing the spring may be employed in the various embodiments.

Figure 10:
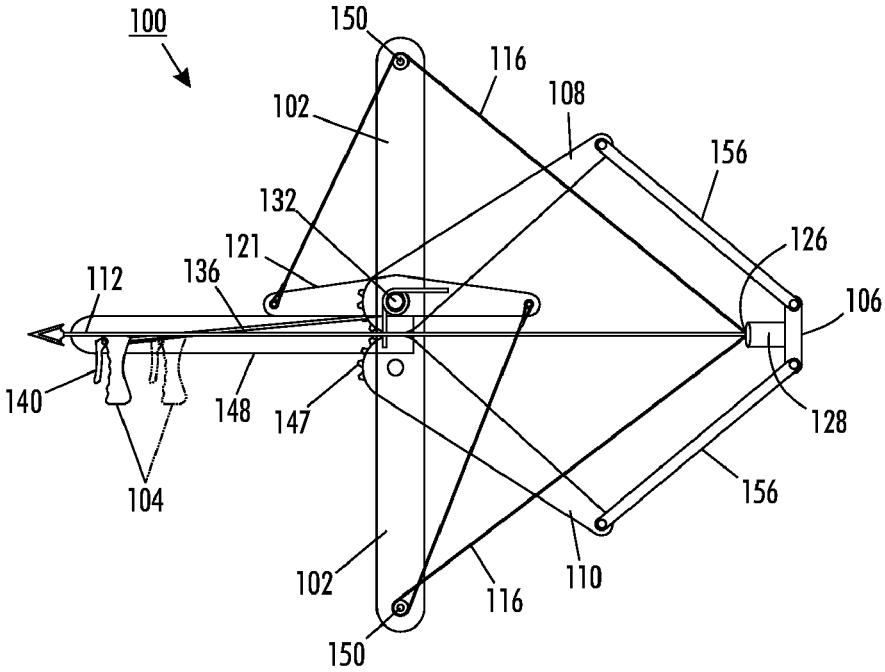
FIGS. 10 and 11 respectively depict an alternative embodiment of a single spring bow in a drawn and undrawn (relaxed) configuration.
Figure 11:
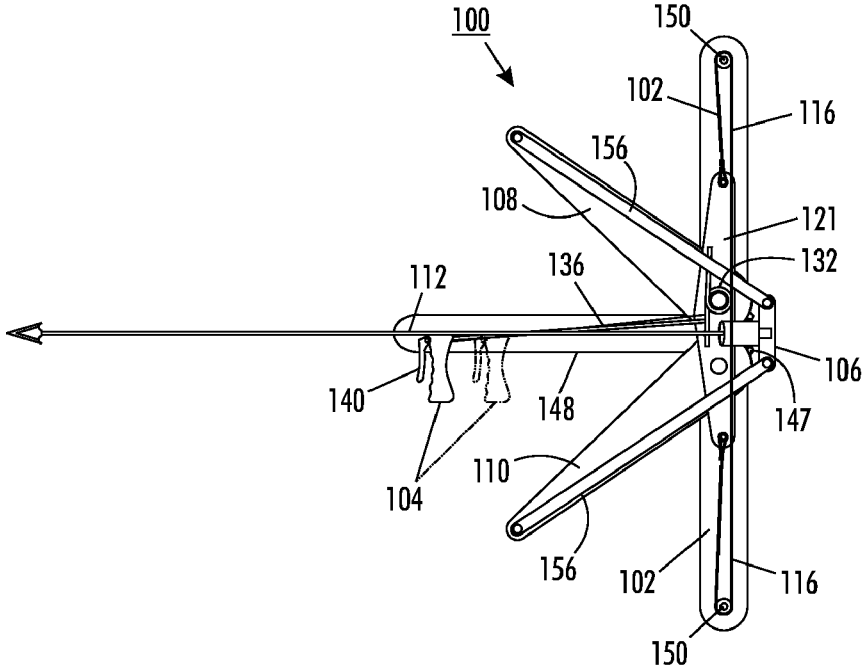

Referring now to FIGS. 10 and 11, depicted therein is another alternative embodiment for the projectile launching device 100 shown, respectively, in a drawn and undrawn configuration. The device 100 comprises a rigid riser 102 including an adjustable forward hand grip 104 operatively associated with said riser. In the embodiments depicted, the adjustable hand grip may be moved along handle guide member 148, which itself is affixed to riser 102. Hand grip 104 may be adjusted using a series of mounting holes (see FIG. 12), or using a conventional clamping arrangement (e.g., a through screw is placed within a longitudinal slot and is tightened with a bolt on the back) to attach the hand grip in a desired position based upon the size of the user (e.g., arm length, draw length). The device also includes at least one spring assembly that includes a spring (e.g., torsion, compression, tension, pressurized cylinder) operatively connected to said rigid riser, the spring assembly also including a rotating member 121 operatively associated with the spring. As in the previous embodiments member 121 rotates or pivots between a neutral (undrawn) position where little or no force is on the member, and a rotated position (approximately about 90-degrees) where the spring assembly is ready to apply force to the bowstring 116 operatively associated with the spring assembly. In one embodiment, each end of the bowstring is attached to the rotating member such that when the member is released a large tensile force is applied to the bowstring. As described above, the bow 100 depicted in FIGS. 10 and 11 may similarly include a trigger 140 associated with the handle 104 (or 106) and a release mechanism, such as release pin (not shown), that will disengage member 121 from crank 108 and consequently convey an instantaneous force from the spring 132 to the bowstring 116. In one embodiment, the release of the energy from the torsion spring will only be possible when at full draw (approx. 90-degree rotation of the torsion spring and member 121), as the release mechanism may be designed to only work when the spring is at full torque and has reached the full draw position. This feature is also unlike conventional re-curve and compound bows. Another advantage of the disclosed device is that it cannot be over-drawn because the crank arms 108 and 110 are intentionally limited in the amount of rotation by the toothed sections thereof (teeth covering only slightly greater than 90-degrees of arc). As noted with respect to the release mechanism described for the other embodiments, the current embodiment contemplates the use of alternative but equivalent mechanisms such as a ratchet, pawl, clutch and the like.

Once a projectile such as arrow 112 is releasably attached to the bowstring via nock 128, a means to energize the spring assembly is used to rotate the member to store energy in the spring assembly. In one embodiment, the means to energize the spring assembly includes crank arms 108 and 110 which are pivotally connected to draw link members 156 and handle 106. By pulling rearward handle 106 away from handle 104, the user is able to rotate member 121 and thereby energize the spring assembly. The crank members move in a coordinated manner as each is in contact with and engages the other via a plurality of teeth located along a portion of the curved periphery of the crank members to form sector gear 147. It will be appreciated that other means may be employed to keep cranks 108 and 110 in contact with each other including contact, belt/pulley, etc. In the depicted representation, draw link members 156 are if a generally rigid material, however an alternative embodiment contemplates the use of a flexible cable or the like as the draw link members.

As discussed previously, instead of the cranks and draw links, it is also possible to use the bowstring itself as the means to energize the spring assembly. In such an embodiment, there would be no mechanical advantage gained through the cranks, but it would reduce the mechanical complexity and cost of the device. As noted above, a trigger such as release handle 140 in conjunction with a release cable 136 are used to control the release of the release pin 138 that provides the interconnection between crank 108 and torsion spring assembly 132. When pulled into a drawn position, the trigger may be activated and upon release of energy stored in the spring assembly the rotating member 121 rotates and the bowstring launches the projectile, arrow 112.

Figure 12:
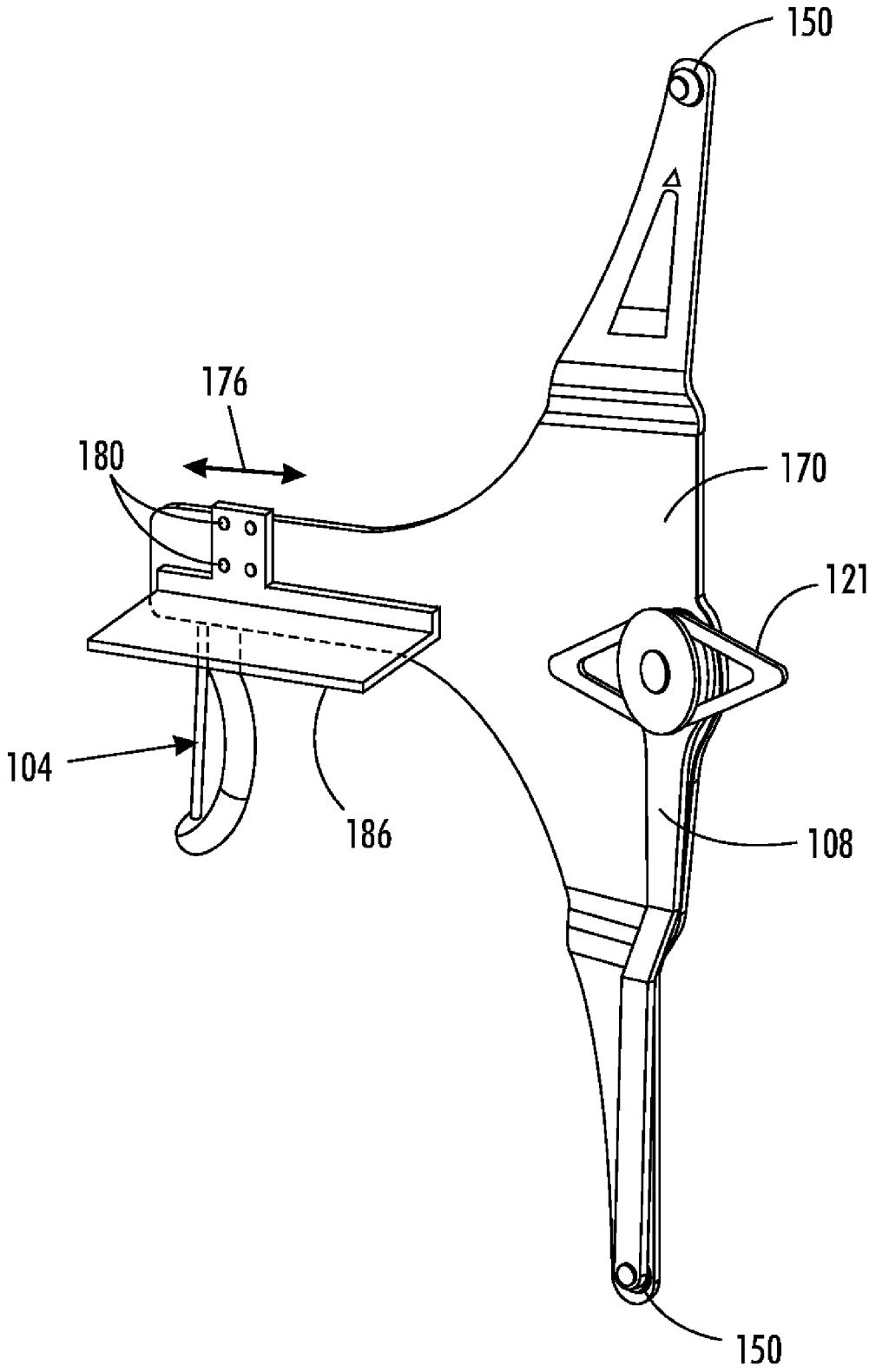
FIG. 12 is a partial perspective view illustrating an alternative design for several components of the bow depicted in FIGS. 10 and 11.

Referring also to FIG. 12, depicted therein are components of an alternative embodiment to that depicted in FIGS. 10 and 11, including an integrated, T-shaped riser with handle guide as member 170. Member 170 includes a vertical portion having rollers 150 on the top and bottom ends, and a horizontal portion with an adjustable handle 104 attached thereto. The location of handle 104 may be adjusted in the direction of reference arrow 176 using a plurality of differently spaced holes (not shown) that correspond with the pattern of four screws 180 illustrated in the figure. In such a configuration the bow is adjustable to fit various users by adjusting the relative distance between the bowstring (not shown in FIG. 12) and the forward handle 104. In addition, an arrow rest and/or target sighting devices may also be attached to the member 170 or the handle 104. In one embodiment, an optional shield 186 may be added to member 170, where shield 186 extends outward and over the arm of the user, thereby shielding the user from the arrow itself, or arrow fragments in the event the arrow is damaged during launch. Shield 186 may be attached to or integrally formed with member 170, and may be of a metal or composite material suitable for providing a protective shield.

Figure 13:
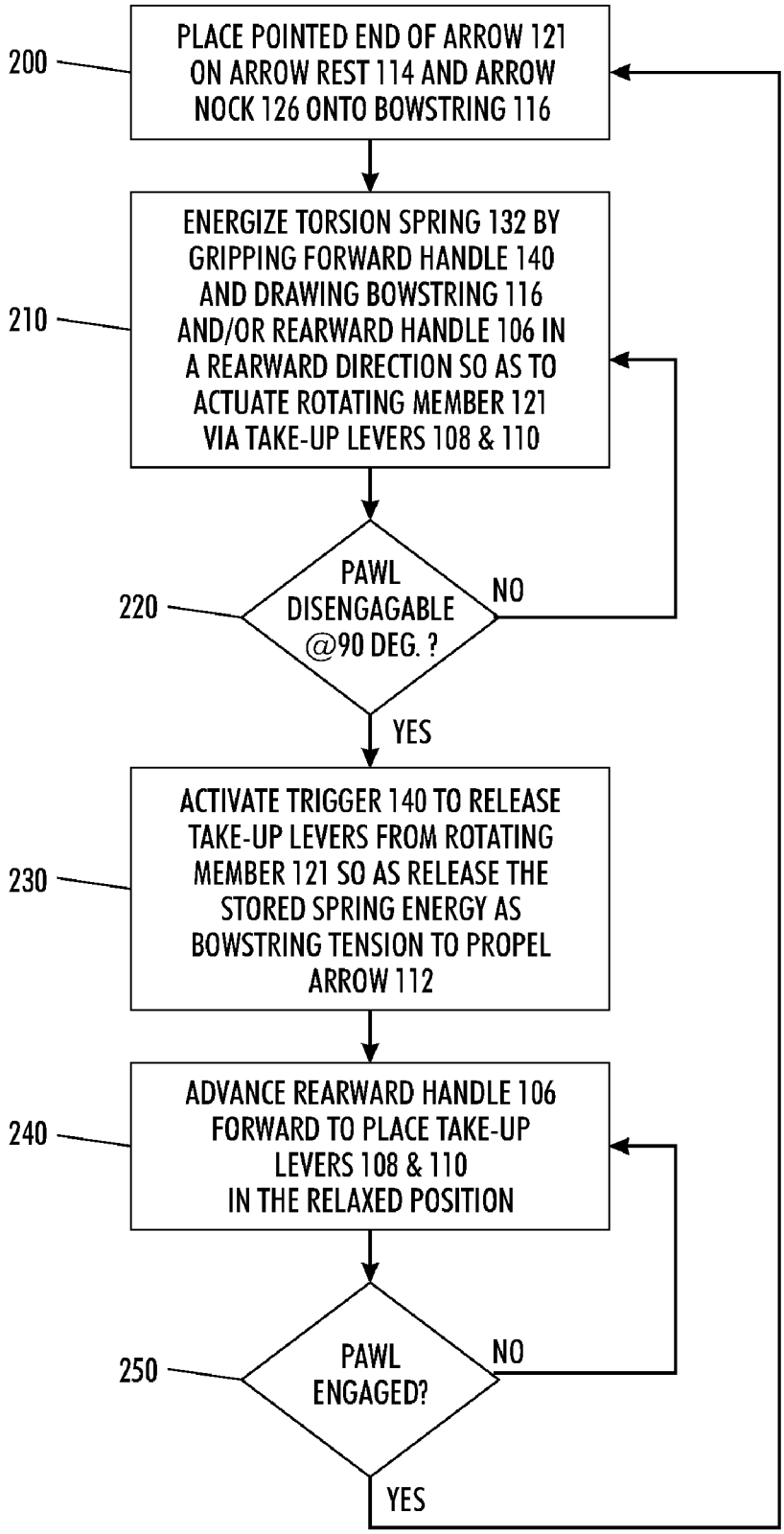
FIG. 13 is an illustrative example of a method of using the device depicted in the various embodiments.

Turning next to FIG. 13, depicted therein is a flowchart illustrating the general steps in operation of a device such as that discussed above. In a general sense, the method for drawing and releasing a bow to propel an arrow, includes, after nocking the arrow (200), applying a linear drawing force to move a pair of engaged spring cranks, the cranks being releasably connected to a spring assembly, to energize a spring by rotating a member attached to the spring in a first radial direction (210), and concurrently drawing a bowstring, with a nocked arrow. The bowstring has each end thereof attached to the rotating member. After drawing the cranks and knocked arrow together, and reaching a fully drawn position at 220, the spring assembly may be decoupled from the spring cranks (230), thereby releasing energy stored in the spring (240). Upon release the rotating member rotates in a second direction, opposite the first direction, and the force applied to the bowstring propels the arrow. Completing the firing cycle, the crank arm is moved back into the relaxed (undrawn) position until a pawl or pin is again engaged to create the connection between the crank and rotating member, thereby preparing for a subsequent drawing of the bowstring and spring assembly (250).

It will be appreciated that various of the above-disclosed embodiments and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the following claims.

What is claimed is:

1. A projectile launching device, comprising:

a rigid riser;

a hand grip operatively associated with said riser;

at least one spring assembly operatively connected to said rigid riser, said spring assembly including a rotating member operatively associated therewith;

a bowstring operatively associated with said spring assembly such that each end of the bowstring is attached to the rotating member;

a projectile releasably attached to said bowstring; and means, in addition to said bowstring, to energize said spring assembly, whereby upon release of energy stored in said spring assembly said rotating member rotates and said bowstring launches the projectile using only the energy stored in said spring assembly; and wherein said means to energize said spring assembly comprises at least one crank arm with a first end thereof releasably connected to the spring assembly and a second end pivotally attached to a drawbar, whereby movement of said drawbar energizes the spring assembly.

2. The launching device according to claim 1, wherein the at least one spring assembly is centrally located along the rigid riser.

3. The launching device according to claim 1, including at least two spring assemblies, each located at opposite ends of the rigid riser and each spring assembly having a respective means, in addition to said bowstring, to energize the spring assembly.

4. The launching device according to claim 1 wherein a position of said hand grip is adjustable relative to said riser.

5. The launching device according to claim 1 further including a release trigger to decouple said energizing means from said spring assembly.

6. The launching device according to claim 5, wherein said release trigger becomes operational only when the spring assembly has reached a fully drawn position.

7. An archery bow, comprising:

a riser;

a hand grip adjustably affixed to said riser;

at least one spring assembly operatively connected to said riser, said spring assembly including a spring and a rotating member operatively associated therewith;

a bowstring operatively associated with said spring assembly such that each end of the bowstring is attached to the rotating member;

an arrow releasably attached to said bowstring; and a pair of engaged spring cranks releasably connected to said spring assembly to energize said assembly and rotate said rotating member in a first direction, where upon release of energy stored in said spring said rotating member rotates in a second direction, opposite the first direction and independent of said spring cranks, applying increased tension to the bowstring and launching the arrow.

8. The bow according to claim 7, wherein the at least one spring assembly is centrally located on the rigid riser.

9. The bow according to claim 7 wherein each of said engaged spring cranks is attached to a draw link, and where movement of said draw link acts upon the spring cranks and energizes the spring assembly.

10. The bow according to claim 7 further including a trigger assembly to decouple said spring cranks from said spring assembly.

11. The bow according to claim 10, wherein said trigger is only operational when the spring assembly has reached a fully drawn position.

12. The bow according to claim 10, wherein said trigger assembly includes:

a trigger; and a release mechanism, responsive to the trigger.

13. The bow according to claim 12, wherein said release mechanism includes a pin suitable for movement between a coupled position in contact with the rotating member of said spring assembly, and a decoupled position not in contact with, and allowing the free movement of, the rotating member of said spring assembly.

14. The bow according to claim 7, wherein the riser is T-shaped and further comprising a protective arm shield associated with a forward-extending portion of the T-shaped riser.

15. A method for drawing and releasing a bow to propel an arrow, comprising:

applying a linear drawing force to move a pair of engaged spring cranks, at least one of the cranks being releasably connected to a spring assembly, to energize said spring assembly by rotating a member attached to said spring assembly in a first radial direction;

concurrently drawing a bowstring, with an arrow nocked thereto, said bowstring having each end thereof attached to the member;

decoupling the spring assembly from the spring crank; and releasing energy stored in said spring wherein said member rotates in a second direction, opposite the first direction, and said bowstring propels the arrow.

16. The method according to claim 15, wherein applying a linear drawing force comprises:

applying a force between a forward handle attached to a riser of said bow and a rearward connection between the spring cranks.

17. The method according to claim 16, wherein said rearward connection includes a draw link connected to respective spring cranks, and where applying the force includes applying a pulling force to the draw link.

18. The method according to claim 15, wherein decoupling the spring assembly only occurs after the spring assembly has been energized to a drawn position.

19. The method according to claim 18, wherein said decoupling occurs in response to movement of a trigger mechanism operatively associated with the spring assembly.

* * * * *